US006964604B2

(12) United States Patent
Chen et al.

(10) Patent No.: US 6,964,604 B2
(45) Date of Patent: Nov. 15, 2005

(54) FIBER EMBEDDED POLISHING PAD

(75) Inventors: Shyng-Tsong Chen, Patterson, NY (US); Kenneth Davis, Newburgh, NY (US); Oscar Kai Chi Hsu, Chelmsford, MA (US); Kenneth Rodbell, Sandy Hook, CT (US); Jean Vangsness, Stow, MA (US)

(73) Assignees: International Business Machines Corporation, Armonk, NY (US); Freudenberg Nonwovens Ltd., Lowell, MA (US)

( * ) Notice: Subject to any disclaimer, the term of this patent is extended or adjusted under 35 U.S.C. 154(b) by 0 days.

(21) Appl. No.: 10/816,882

(22) Filed: Apr. 5, 2004

(65) Prior Publication Data

US 2005/0079805 A1 Apr. 14, 2005

Related U.S. Application Data

(63) Continuation-in-part of application No. 09/599,514, filed on Jun. 23, 2001, now Pat. No. 6,383,066.

(60) Provisional application No. 60/214,774, filed on Jun. 29, 2000.

(51) Int. Cl.[7] ..... B24D 11/00
(52) U.S. Cl. ..... 451/532; 451/527; 451/41
(58) Field of Search ..... 451/532, 526, 451/527, 528, 530, 533, 536, 539, 531, 41; 51/297, 298, 299

(56) References Cited

U.S. PATENT DOCUMENTS

| | | | | |
|---|---|---|---|---|
| 5,876,269 | A | 3/1999 | Torii | |
| 5,876,490 | A | 3/1999 | Ronay | |
| 5,968,280 | A | 10/1999 | Ronay | |
| 5,984,769 | A | 11/1999 | Bennett et al. | |
| 5,989,111 | A | 11/1999 | Lamphere et al. | |
| 6,051,496 | A | 4/2000 | Jang | |
| 6,069,080 | A | 5/2000 | James et al. | |
| 6,099,954 | A | 8/2000 | Urbanavage et al. | |
| 6,383,066 | B1 * | 5/2002 | Chen et al. | 451/532 |
| 6,533,645 | B2 * | 3/2003 | Tolles | 451/41 |
| 6,656,018 | B1 * | 12/2003 | Hsu et al. | 451/41 |
| 6,688,957 | B2 * | 2/2004 | Tolles | 451/532 |
| 6,712,681 | B1 * | 3/2004 | Chen et al. | 451/532 |

* cited by examiner

*Primary Examiner*—Dung Van Nguyen
(74) *Attorney, Agent, or Firm*—Connolly Bove Lodge & Hutz LLP; Robert M. Trepp

(57) ABSTRACT

A polishing pad having a body comprising fibers embedded in a matrix polymer formed by a reaction of polymer precursors. The loose fibers define and the precursors were mixed first with curatives, then mold into a pad form. The pad may include a thin layer of free fibers at its polishing surface. A segment of at least a portion of the free fibers are embedded in the adjacent body of the polymer and fibers.

22 Claims, 2 Drawing Sheets

FIBER EMBEDDED POLISHING PAD

RELATED APPLICATIONS

This application is a Continuation-In-Part of U.S. patent application Ser. No. 09/599,514, filed Jun. 23, 2001, which issued May 7, 2002 as U.S. Pat. No. 6,383,066 (Multilayered Polishing Pad, Method for Fabricating, and Uses Thereof). This application claims the benefit under 35 U.S.C. § 119(e) of Provisional Application Ser. No. 60/214,774, filed Jun. 29, 2000, entitled "Grooved Polishing Pads and Methods of Use." The entire contents of these applications is herein incorporated by reference for all purposes. This application also claims the benefit of, and specifically incorporates by reference, the entire contents of application Ser. No. 09/668,142, filed Sep. 25, 2000, which issued as U.S. Pat. No. 6,656,019.

FIELD OF THE INVENTION

The present invention relates to polishing pads. The polishing pads of the present invention are especially useful in chemical-mechanical planarization of semiconductor wafers. Specifically the invention relates to pads of increased stiffness to prevent over polishing, and increased hardness and thickness for greater useful life. The present invention is also applicable to the polishing of other surfaces, for example optical glass, CRT, and flat panel display screens. The present invention further relates to methods for fabricating and using the pads.

BACKGROUND OF INVENTION

For many years, optical lenses and semiconductor wafers have been polished by chemical-mechanical means. More recently, this technique has been applied as a means of planarizing intermetal dielectric layers of silicon dioxide and for removing portions of conductive layers within integrated circuit devices as they are fabricated on various substrates. For example, a conformal layer of silicon dioxide may cover a metal interconnect such that the upper surface of the layer is characterized by a series of non-planar steps corresponding in height and width to the underlying metal interconnects.

The rapid advances in semiconductor technology has seen the advent of very large scale integration (VLSI) and ultra large scale integration (ULSI) circuits resulting in the packing of very many more devices in smaller areas on a semiconductor substrate. The greater device densities require greater degrees of planarity to permit the higher resolution lithographic processes required to form the greater number of devices having smaller features as incorporated in current designs. Moreover, copper, because of its low resistance, is increasingly being used as interconnects. Conventionally, etching techniques are used to planarize conductive (metal) and insulator surfaces. However, certain metals, desirable for their advantageous properties when used as interconnects (Au, Ag, Cu) are not readily amenable to etching, thus the need for chemical-mechanical polishing (CMP).

Typically, metal interconnects are formed through lithographic or damascene processes. The damascene technique is described in U.S. Pat. No. 4,789,648, to Chow, et al. assigned to the assignee of the present invention, the entire contents of which are incorporated herein by reference. For example, in a lithographic process, a first blanket metal layer is deposited on a first insulating layer, following which, electrical lines are formed by subtractive etching through a first mask. A second insulating layer is placed over the first metallized layer, and holes are patterned into the second insulating layer using a second mask. Metal columns or plugs are formed by filling the holes with metal. A second blanket metal layer is formed over the second insulating layer, the plugs electrically connecting the first and second metal layers. The second metal layer is masked and etched to form a second set of electrical lines. This process is repeated as required to generate the desired device.

Presently, VLSI uses aluminum for the wiring and tungsten for the plugs because of their susceptibility to etching. However, the resistivity of copper is superior to that of either aluminum or tungsten, making its use desirable, but copper does not have as desirable etching properties.

Variations in the heights of the upper surface of the intermetal dielectric layer have several undesirable characteristics. The optical resolution of subsequent photolithographic processing steps may be degraded by non-planar dielectric surfaces. Loss of optical resolution lowers the resolution at which lines may be printed. Moreover, where the step height is large, the coverage of a second metal layer over the dielectric layer may be incomplete, leading to open circuits.

In view of these problems, methods have been evolved to planarize the upper surfaces of the metal and dielectric layers. One such technique is chemical-mechanical polishing (CMP) using an abrasive polishing agent worked by a rotating polishing pad. A chemical-mechanical polishing method is described in U.S. Pat. No. 4,944,836, Beyer, et al., assigned to the assignee of the present invention, the entire contents of which are incorporated herein by reference. Conventional polishing pads are made of a relatively soft and flexible material, such as nonwoven fibers interconnected together by a relatively small amount of a polyurethane adhesive binder, or may be laminated layers with variations of physical properties throughout the thickness of the pad. Multilayer pads generally have a flexible top, polishing layer backed by a layer of stiffer material.

The CMP art combines the chemical conversion of a surface layer to be removed, with the mechanical removal of the conversion product. Ideally, the conversion product is soft, facilitating high polishing rates. CMP pads must resolve two constraints relevant to the present invention. The surface in contact with the substrate to be polished must be resilient. Of particular relevance to the present invention is the problem of local over polishing, also known as "dishing," resulting from too flexible a pad. This is one of the key problems encountered during CMP of metal substrates. Also, an increased number and density of defects in the polished surface may be caused by frayed and loose fibers that develop as conventional fibrous pads become worn. Such defects correlate with low yields of product.

Some of the most commonly used polishing pads for manufacturing semiconductor chips are a very soft foam pad, or a soft nonwoven fiber pad. An advantage of a soft polishing pad is low defect density on the polished wafer and good within-wafer uniformity. However, soft CMP pads suffer from very short pad life requiring replacement after polishing about 50 wafers, and excessive dishing of the polished wafer because of the pad softness. Moreover, for metal damascene CMP processes, a soft pad usually causes much more dishing compared with a hard pad.

It is generally known that prevention of dishing requires a stiffer pad. Thus, a hard polishing pad usually has better planarization capability than a soft pad. However, the defects count is much higher than with the soft pad and the within-wafer uniformity is usually much worse. In addition, hard pads may be conditionable, which means that the pad surface condition can be regenerated using a diamond disk or an abrasive roller to recondition the pad surface by removing worn areas and embedded debris. This reconditioning capability means that a hard pad may last much longer than a soft pad. Such reconditioning in situ also means that polishing tool down time for pad replacement is greatly reduced.

Currently, these problems are handled using multi-step techniques wherein initial polishing is effected at a high rate using one set of pads and abrasive compounds, followed by a second polishing step using a second set of pads and abrasive compounds differently optimized in comparison to the first set. This is a time consuming process and, moreover, it also suffers from high defect densities due to the use of two different pads. For Cu planarization, CMP pads are critical, and are as important as the abrasive slurry. Fibrous pads of the prior art have been too soft to obtain good planarization. Stacked nonwoven fiber and other types of pads have previously been tried in an attempt to obtain better CMP performance. However, thin (5 to 20 mils thick) pads of nonwoven fibers bound with polyurethane are not sufficiently durable and do not long survive the CMP process.

Accordingly, the need exists for improved fibrous polishing pads. A high quality CMP pad should meet the following requirements: produce extremely low defects counts on polished surfaces, cause extremely small dishing and extremely low erosion of polished surfaces, and have a long pad life extendible by reconditioning. None of the existing conventional CMP pads meet all of these requirements, which are needed for the future generation of CMP processes. A new type of CMP pad is therefore needed to meet these requirements.

SUMMARY OF INVENTION

The present invention addresses problems in the prior art and provides a relatively thick, stiff and hard pad comprising loose fibers embedded in a polymer matrix. Loose fibers were mixed with the polymer resin and reactants for producing the polymer matrix before those reactants are fully cured. The resulting fiber embedded polymer composite is sufficiently hard to be compatible with current and future CMP process chemistry, and is conditionable after use by grinding (dressing) with a diamond containing abrasive disk or roller to regenerate the working surface of the pad. The pad thickness may also be greater than previously used, which together with pad reconditionability, means that the pad life is significantly longer, such as polishing 400 to 1,000 wafers before pad replacement becomes necessary. Applications are envisioned in the semiconductor and optical industries.

An aspect of the present invention provides a polishing pad having a body comprising polymer fibers; at least one backing layer comprising a portion of said fibers embedded in a cured polymer matrix; and a polishing layer comprising a free length of said fibers disposed as a fibrous mat substantially free of said polymer matrix.

The present invention also relates to a method of making the above disclosed pads. In particular, the method comprises pressing the reactants into a mold and then curing the reactants to produce the above disclosed polishing pad. Both heat and pressure are applied to cure the precursor system within the mold. After curing and removal from the mold, the pad may be buffed with an abrasive disk or roller to remove a skin-like covering and to fracture a surface portion of the polymer to form a thin polishing surface layer of free fibers, segments of which remain embedded in the adjacent composite body.

An aspect of the present invention provides a method of fabricating a polishing pad comprising providing a mold having a cavity; introducing fibers into said mold cavity, the loose fibers defining interstices; introducing polymerization reactants into said mold cavity; applying a differential pressure across said mold cavity thereby causing said reactants to substantially fill said interstices; effecting at least a partial cure of said reactants to form a polymer matrix; abrading said matrix from at least one major surface of said pad thereby forming a fibrous mat of fibers having a free length on said major surface.

Still other objects and advantages of the present invention will become readily apparent to those skilled in the art from the following detailed description, wherein is shown and described preferred embodiments of the invention, simply by way of illustration of the best mode contemplated for carrying out the invention. As will be realized by the skilled person, the invention is capable of other and different embodiments, and its details are capable of modifications in various obvious respects, without departing from the invention. Accordingly, the description is to be regarded as illustrative in nature and not as restrictive.

Still other objects and advantages of the present invention will become readily apparent by those skilled in the art from the following detailed description, wherein it is shown and described preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

BRIEF DESCRIPTION OF DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

It is to be noted, however, that the appended drawings illustrate only typical embodiments of this invention and are therefore not to be considered limiting of its scope, for the invention may admit to other equally effective embodiments.

BEST AND VARIOUS MODES FOR CARRYING OUT THE INVENTION

Reference is made to the figures to illustrate selected embodiments and preferred modes of carrying out the invention. It is to be understood that the invention is not hereby limited to those aspects depicted in the figures.

Figure 1:
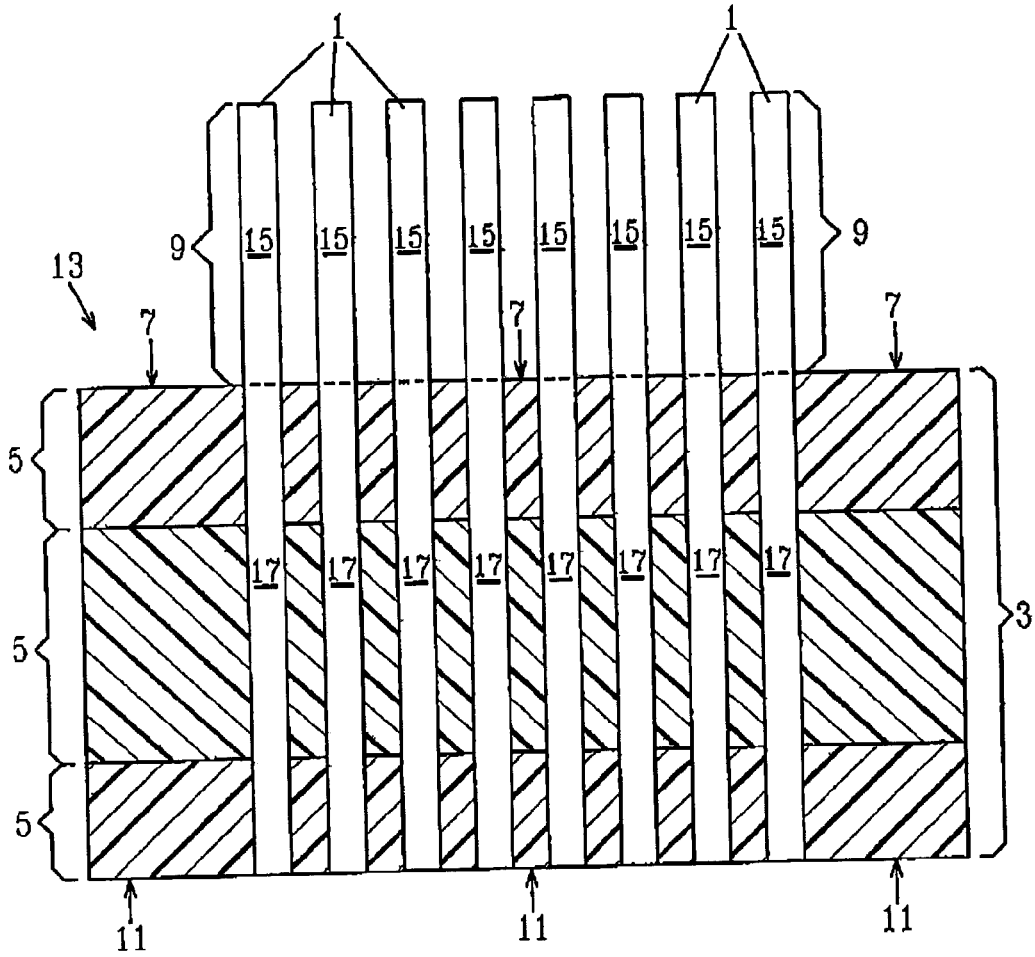
FIG. 1 depicts a cross-section of a polishing pad of the invention.

FIG. 1 is a cross-section detailing features of the inventive pad. Pad 13 comprises an array of fibers 1, embedded in a backing layer 3 of a cured polymer. Backing layer 3 may comprise a plurality of layers 5. Polymer layer 3 may be termed a polymer matrix. Pad 13 comprises a back surface 11 and a front-side, or polishing surface 7. Fibers 1 comprise regions 17 embedded in matrix layer 3 and regions 15 free of matrix polymer 3.

FIG. 1 depicts fibers 1 oriented substantially perpendicular to the surface of the pad. In other, and preferred embodiments, fibers 1 are oriented at random angles to the pad surface. Free regions 15 may be characterized by a free length 9, a length of fiber extending outwards of polymer matrix surface 7.

Figure 2:
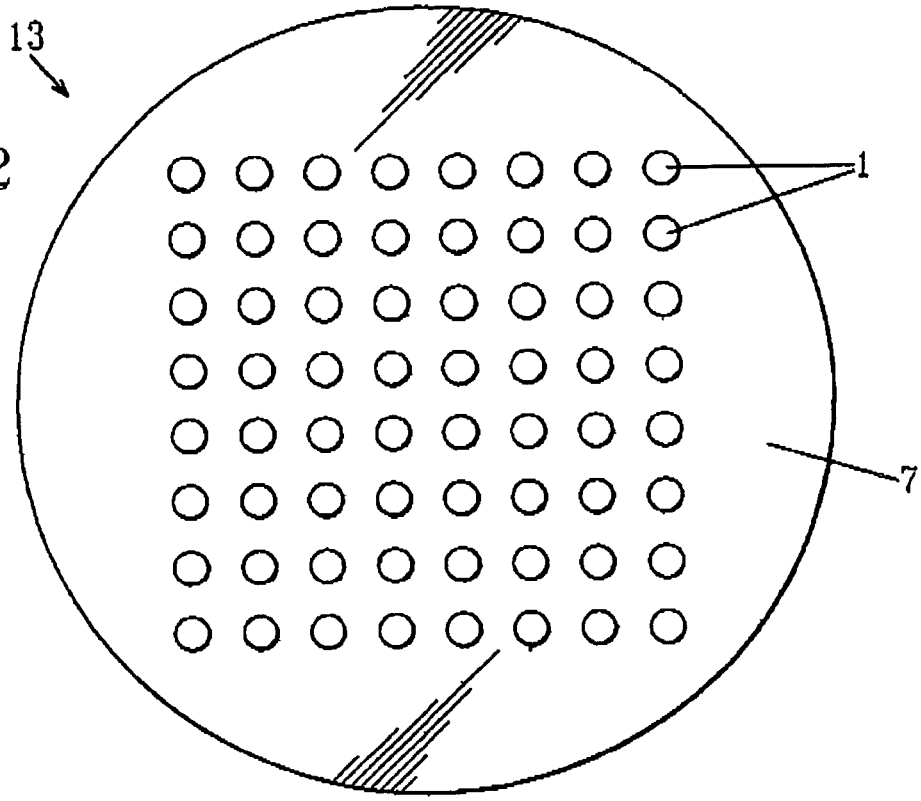
FIG. 2 depicts a top view of a polishing pad of the invention.

FIG. 2 depicts a top view of an array of fibers 1 proximate to a polishing surface 7. FIG. 2, for graphical convenience, depicts fibers 1 disposed as a regular array. In a preferred embodiment, the fibers are disposed randomly.

Figure 3:
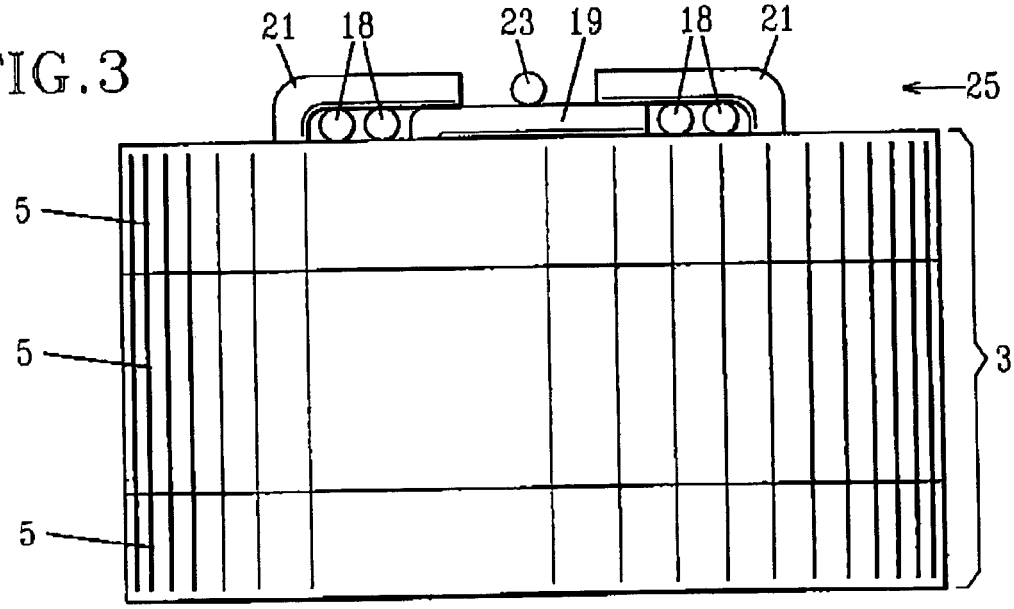
FIG. 3 depicts a side elevation schematic of fibers on the surface of the pad.

FIG. 3 depicts polymer layer 3 having a fibrous mat 25 disposed on a polishing surface thereof. Fibrous mat 25 is composed of randomly-oriented portions of free lengths 9 of fibers 1. In FIG. 3, some fibers 17 lay essentially flat along the polishing surface and are oriented so as to run into and out of the plane of the paper. Some fibers 19 lay essentially flat on the surface and are aligned substantially in the plane of the paper. Some fibers 21 are aligned substantially in the plane of the paper, but at least portions thereof lay atop other fibers (17, 19). Some fibers 23 lay atop other fibers and are oriented so as to run into and out of the plane of the paper.

Fibers 17 and 19 form a first layer; fibers 21 and 23 form a second layer. The pad may have at least one layer. The pad may have a plurality of layers.

The composition of the fibers comprises polymers of first and second polymer groups. Polymers of a first fiber group are preferred. Typical materials suitable as a first fiber group are Rayon, polycarbonate, polyamide, polyphenylene sulfide, polyimide, Aramide fibers including Nomex and Kevlar, polyvinylchloride, Hemp, and combinations of these fibers. Typical materials suitable as a second, lesser preferred, fiber group are polyester, polypropylene, Nylon, acrylic, and polyethylene, and combinations of these fibers. The listed fibers are meant to be illustrative of the types that may be used, but the invention is not thereby limited to the enumerated types. The fibers of the first group are preferred because they provide pads having a higher hardness than the fibers of the second group. Combinations of the fibers of the first and second groups are also possible. The fibers and matrix polymers together typically have a hardness of about 30 Shore D to about 100 Shore D, and preferably about 40 Shore D to about 80 Shore D, and more preferably about 50 Shore D to about 70 Shore D, as measured by Durometer Hardness test method ASTM D2240.

The fibers are preferably in the form of individual fibers with a preferred length of from about ½ inch to about 5 inches, and a preferred diameter from about 5 $\mu$m to about 501 $\mu$m (micrometers).

The fiber surface may be coated with a layer of a coating polymer. The coating polymer may be the same as the fiber polymer. The coating polymer may differ from the fiber polymer. Suitable coating polymers include any polymer recited above as suitable for the fiber polymer.

The present invention includes a method of fabricating the inventive pad. loose fibers are placed into a mold. Prior to their introduction into a mold, the fibers may be coated with a coating polymer. The loose fibers define a plurality of interstitial spaces.

Polymerization reactants are introduced into the mold. Polymerization reactants include resins, monomers, oligomers, catalysts, solvents, diluents and other agents that may react to form a matrix polymer.

A differential pressure is applied across the mold to force the reactants into the interstitial spaces. It is preferred that the reactants substantially fill the interstitial spaces. It is more preferred that the reactants completely fill the interstitial spaces.

The reactants are cured to a polymer. Complete, or full, cure may be obtained in a single stage. Alternatively, it may be preferable to cure in two or more stages. For example, the pad may be partially cured, a groove may be formed in one or both major surfaces, following which, the pad may be fully cured.

The thickness of a new molded pad is preferably in the range from about 10 mils to about 150 mils. The pad is sufficiently strong and cohesive to be used and reconditioned down to a thickness of about 5 mils.

Non-limiting examples of suitable matrix polymers include polyurethanes including polyester and polyether urethanes, polycarbonates, polyacrylates including polymethylmethacrylate (PMMA), polyaramides, thermosetting polymers such as epoxies and derivatives of epoxies, and combinations of these polymers.

The physical-chemical, and hence the polishing performance, of the fiber and polymer composite are governed by the types and sizes of the fibers, the types and hardness of the polymers, the fiber to polymer ratio, the friability of the polymers, and the local and global distribution of the polymer matrix within the fiber mat. For example, employing a larger fiber diameter (thus with fewer fibers for a given density of the fiber mat) and the use of a high fiber: polymer ratio will result in a pad structure having a lower overall density and surface hardness, and a higher compressibility. Conversely, employing a smaller fiber diameter, a lower fiber: polymer ratio, and harder polymer types will result in a pad structure having higher density, lower compressibility and higher surface hardness.

The molded pad may be solid or porous. If porous, it is preferable that the pore sizes be in the range of 5–100 microns, more preferably 20–60 microns, to achieve the desired hardness. If the molded pad is porous, a uniform porosity and a higher density yields pads with better polishing uniformity, less dishing, and a higher polishing rate. This permits greater process throughput and greater product yields.

Microspheres may be incorporated into the polymerization mixture to create pores in the pad. The microspheres may have a diameter of from about 10 $\mu$m (micrometers) to about 100 $\mu$m. Microspheres may comprise up to about 20 weight percent of the pad and preferably comprises about 3 weight percent of the pad. Microspheres may comprise a polymer.

The pads of the present invention typically comprise fibers from about 30 to about 70 percent by weight and preferably from about 40 to about 60 percent by weight. Correspondingly, the pads comprise a polymeric matrix typically from about 70 to about 30 percent by weight and preferably from about 60 to about 40 percent by weight. The percentages of the fibers and polymeric precursor are based upon the total weight of the fibers and polymeric matrix in the pad.

The pads of the present invention preferably have densities of from about 0.5 g/cc to about 1.1 g/cc (grams per cubic centimeter), and the fiber mats from which the pads are made preferably have densities of from about 0.15 g/cc to about 0.9 g/cc. To ensure the desired hardness of the pad, the fiber mat comprises loose fibers which are completely mixed with precursors and reactants suitable to form the desired polymer matrix. Persons of skill will be able to determine suitable mixtures to yield a polymer matrix possessing the desired hardness after the reactants are cured. The cured fibrous polymer preferably forms a relatively hard but friable matrix.

Following cure, the molded pad is conditioned by buffing with a diamond disk or opposing inline abrasive rollers. Conditioning removes a skin-like polymer surface. Matrix polymer 3 is abraded from at least one major surface of the pad. Abrasion frees a region of fiber 15 from matrix 3. Preferably, conditioning exposes a region 15 sufficient to provide about a 1 to 2 mil thickness of fiberous mat.

The creation of this surface layer results from the friable nature of the cured polymer matrix. In other words, the strength of the fiber is stronger than the polymer matrix material such that, during buffing, the polymer material is removed at the surface while the surface fibers remain attached to the main body or backing layer of the fiber and polymer composite. Thus, after buffing, a small thickness or depth of surface polymer is removed to leave a thin surface layer of free fibers, segments of at least a portion of which remain embedded in the adjacent composite body of polymer and fibers. During CMP processes, this fibrous polishing surface helps to reduce by up to about 90% or more of the defect count caused by using a conventional hard pad. In addition, the solid matrix formed by the polymer makes the pad up to 50% harder than the hardest conventional CMP pad presently on the market.

Accordingly, the thin fibrous surface layer of the preferred pad of the present invention significantly reduces the defect count of the wafers polished therewith, and the hard backing body or layer beneath the fibrous surface layer results in much less dishing of the polished wafer surface. As a result, metal dishing can be minimized to less than about 0.04% of the size of the metal features on the wafer. In addition, erosion of the wafer surface is very small so as to be negligible.

The pad surface may be reconditioned, after polishing one or more wafers, to maintain a high performance level. This makes the pad service life much longer (potentially over 1,000 wafers) than conventional soft fiber-based pads. Conditioning recreates the thin (about 1 to 2 layers of fibers) fibrous surface layer which continues to help reduce the defects count, while the underlying hard fiber and polymer body sufficiently fixes and supports the fiber layer to reduce the dishing phenomenon. The layer may be from about 1 to about 10 mil thick; preferably from about 1 to about 5 mil thick; and more preferably from about 1 to about 2 mil thick.

The pads may have multiple layers, as described in U.S. patent application Ser. No. 09/599,514, to allow for independent optimization of pad stiffness and hardness in independent layers. A bottom support layer imparts mechanical stiffness to the pad. The stiffness of the bottom support layer is preferably optimized in relation to the malleability of the material comprising the surface to be worked. The top working layer, the body of which carries and which includes the thin surface layer of free fibers, is preferably optimized with respect both to the properties of the surface to be polished, and with respect to the chemical properties of the abrasive mixture used in the CMP process.

Typically, the support layer(s) has stiffer fibers and is thicker than the layer carrying the free fibers used as the polishing surface, and is typically about 55% to about 90% of the total thickness of the pad.

As indicated above, stacked nonwoven and other types of fibrous pads have been tried in the past in an attempt to obtain better CMP performance. However, thin (5 to 15 mil thick) fibrous pads are not sufficiently durable and do not survive the CMP process. In the present invention, a single-body polishing pad or the working body of a multi-layer pad can be buffed down to 5 mils while still maintaining structural integrity required for the CMP process. In either form, the free fiber layer provides a scratch-free polishing surface and the hard underlying body reduces the excessive dishing which usually occurs during CMP with softer pads. Thus the invention allows for independent control of the optimal properties to prevent over polishing, for compatibility with the substrate to be polished, and for compatibility with the polishing compound.

According to the present invention, the fibers may be pre-coated with a polymer prior to being embedded in the matrix polymer. The pre-coating polymer may be the same or a different polymer as that of the fiber. Examples of polymers suitable for pre-coating the fibers are copolymers of styrene and an acrylate, acrylonitrile rubbers; and butadiene-styrene rubbers, polyurethanes, fluorocarbons, and epoxy resins. The acrylate of the co-polymer may be a methacrylate such as ethyl or methyl acrylate or other methacrylate.

Pre-coating may help maintain the stability of the free fibers by enhancing adhesion of segments of these fibers to the polymer matrix. A pre-coating polymer may be used in amounts of from about 10 to about 90% by weight and preferably from about 15 to 50% by weight based upon the total weight of the fibers and pre-coating.

The pads of the present invention can be fabricated by mixing loose fibers and an unreacted viscous polymer precursor system. A preferred, but non-limiting polymer precursor system is an isocyanate system. Preferred isocyanates include, but are not limited to, ADIPRENE from Uniroyal and AIRFLEX from Air Products. A polymer precursor system may be termed polymerization reactant(s). Polymerization reactants may include, but are not limited to: monomers, oligomers, resins, catalysts, accelerants, and curatives.

A fiber—polymer precursor mixture is introduced into a mold which is then closed and sufficient differential pressure is applied for causing the polymer precursors to substantially completely fill in the mold. As an alternative to pressurizing the mold, a vacuum may be used to pull the polymeric reactants (precursors) into the mold. A suitable vacuum may be about minus 10 psig.

During or after this "fill" stage, the mold is heated to affect either a partial or a final cure of the matrix polymer. The curing of the matrix polymer is typically performed at temperatures of about 60° to about 250° F., preferably about 100° F. to about 180° F. Cure is suitably effected under a pressure of about 1 psig to about 200 psig preferably about 10 psig to about 150 psig, more preferably about 50 psig to about 75 psig. Cure is effected for about 5 to about 24 hours.

Pads may be removed from the mold after only partial curing the polymer. Subsequently, a final cure may be affected at ambient pressure in an oven or the like. The time and temperature of final cure depending on the polymer and extent of the partial cure.

Commercially available composite fiber and polymer pads used just enough polymer to bind together the non-woven fibers of a mat. In contrast, the present invention substantially completely fills the interstices of the fiber with polymer precursor reactants. Polymer reactants may include, as a non-limiting example, an isocyanate system for polyurethane. By substantially filling the fiber interstices, the present invention confers the advantage of an extremely hard polymer matrix with embedded fibers. The pads of the invention also may be made of one or more such hard layers of fiber and polymer composite.

The fibers of the mat used have fiber diameters preferably in the range of about 5 microns to about 100 microns, more preferably about 10 microns to about 50 microns, and most preferably about 15 microns.

Because of the unusually hard matrix of the pad, it may be relatively inflexible. Therefore, after molding has been completed, the pad may be provided with holes and/or grooves to increase its flexibility. Where holes are used to increase pad flexibility, they preferably pass all the way through the pad from the working side to the mounting side. The holes are preferably in the range of from about 1/16 inch to about 1/4 inch in diameter. Where 1/4 inch holes are adopted, they are preferably spaced about 1/2 inch apart. Where 1/16 holes are adopted, they are preferably spaced about 1/4 inch apart.

The inventive pads may have at least one groove on a backside of the pad. The backside groove may increase the flexibility of the pad. The inventive pads further may have at least one channel, disposed transverse to a long axis of the pad. The inventive channel provides fluid communication between the backside groove(s) and the polishing surface. While in service, the backside of the inventive pad is vacuum mounted on a rotating platen such that a continuous fluid path is established from the polishing surface, the fluid channel, and the backside groove to a fluid outlet defined in the platen. The frontside is provided an amount of a polishing slurry. The slurry may be continuously provided from a reservoir. The inventive fluid channel permits the continuous withdrawal of used slurry. The inventive fluid channel further permits the admission of air or other gas from the ambient to the backside of the pad. A backside groove and a fluid channel are disclosed in U.S. Pat. No. 6,656,019 assigned to the assignee of the present invention the entire contents of which are specifically incorporated by reference and for all purposes.

The pads of the present invention are especially amenable to grooving to provide a grooved polishing pad that is capable of consistently forming uniformly polished surfaces on high quality wafers. The apparatus for grooving a pad may comprise a platen with positioning post for holding the pad in position for engagement by a router to machine grooves in the working surface of the pad. In order to precisely control the depth of the grooves as they are routed in the pad, a spacing mechanism may be used to provide a constant and precise separation between the working surface of the pad and the chuck for holding and rotating the router. An apparatus of this type is described in U.S. patent application Ser. No. 09/605,869, filed Jun. 29, 2000, for a "Polishing Pad Grooving Method and Apparatus", the entire contents of this application being incorporated herein by reference. Fibers of conventional pads are often frayed by such grooving processes. However, fibers of the present inventive pads, whether precoated or not, do not sustain significant fraying during the grooving process.

The present pad design therefore offers a versatility of properties and performance required to give a high degree of planarization and global uniformity to a variety of polished substrates. The pads of the present invention can be used for polishing aluminum and aluminum alloys such as Al—Si and Al—Cu Cu, Cu alloys, W, W alloys, a variety of adhesion and diffusion barriers such as Ti, Ti alloys, TiN, Ta, Ta alloys, TaN, Cr, and the like, silicon oxide, polysilicon, silicon nitride, Au, Au alloys, as well as other metals and alloys, and glasses of various compositions.

The polishing slurries employed can be any of the known CMP slurries. Particular examples are alumina in deionized water, or an acidic composition having a pH less than 3 obtained by the addition of hydrofluoric or nitric acid to the alumina and water slurry; and slurries with pH 3 or greater, including basic slurries having a pH above 7.

An embodiment, suitable for the semiconductor industry, is a substantially cylindrical pad having general dimensions such that it might be used in a polishing apparatus, for example in the equipment described in the IBM Technical Disclosure Bulletin, Vol. 15, No.6, November 1972, pages 1760–1761, the entire contents of which are incorporated herein by reference.

As an alternative embodiment, the polishing apparatus includes a polishing station having a rotatable platen on which is mounted a polishing pad, such as illustrated diagrammatically in FIG. 14 of Provisional Application Ser. No. 60/214,774, referred to above. The pad in this embodiment is preferably about 10 to about 36 inches, more preferably about 24 inches in diameter, the latter being capable of polishing "eight-inch" or "twelve-inch" semiconductor wafers. The platen typically rotates the pad at speeds trom 30 to 200 revolutions per minute, though speeds less than and greater than this range may be used. Semiconductor wafers are typically mounted on a rotatable carrier head using a vacuum chuck. The head presses the wafer against the pad causing polishing, for example with 1 to 10, preferably 2 to 8 pounds per square inch pressure, but greater or lesser pressures could also be used. The rate of polishing is controlled by the composition of the slurry, the rotation rates of the head and platen, and the contact pressure.

Polishing tests on Cu revealed that pads of the present invention provided excellent results that are not obtainable with currently available pads.

The foregoing description of the invention illustrates and describes only the preferred embodiments of the present invention. However, as mentioned above, it is to be understood that the invention is capable of being made and used in various other combinations, modifications, and environments, and is capable of being changed or modified within the scope of the inventive concept as expressed herein, commensurate with the above teachings and/or the skill or knowledge of persons skilled in the relevant art. The embodiments described hereinabove are further intended to explain the best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

INCORPORATION BY REFERENCE

All publications and patent applications cited in this specification are herein incorporated by reference, and for any and all purposes, as if each individual publication or patent application were specifically and individually indicated to be incorporated by reference. In the case of inconsistencies the present disclosure will prevail.

Having thus described our invention, what we claim as new, and desire to secure by Letters Patent is:

1. A polishing pad having a body comprising:

polymer fibers;

at least one backing layer comprising a portion of said fibers embedded in a cured polymer matrix; and a polishing layer comprising a free length of said fibers disposed as a fibrous mat substantially free of said polymer matrix.

2. The polishing pad, according to claim 1, wherein said fibers comprise a polymer selected from the group consisting of polyester, polypropylene, polyamide, rayon, polymide, polyphenylene, and combinations thereof.

3. The polishing pad according to claim 1, wherein the thickness of said fibrous mat length is up to about 10 mils.

4. The polishing pad according to claim 1, wherein said fibers are coated with a polymer selected from the group consisting of styrenes, acrylates, methacrylates, acrylonitrile rubbers, butadiene-styrene rubbers, polyurethanes, fluorocarbons, and epoxies.

5. The polishing pad according to claim 1, wherein said matrix is a polymer selected from the group consisting of polyester and polyether urethanes, polycarbonates, polyacrylates, polymethylmethacrylates, polyaramides, thermosetting polymers, epoxies, and combinations thereof.

6. The polishing pad according to claim 1, wherein said matrix polymer is solid or porous.

7. The polishing pad according to claim 1, wherein said pad has a Durometer hardness in the range of from about 50 to about 100 Shore D.

8. The polishing pad according to claim 1, wherein, said pad comprises from about 20% to about 80% fibers by weight and from about 80% to about 20% matrix polymer by weight.

9. The polishing pad according to claim 1, wherein, said pad has a density in of from about 0.5 to about 1.1 grams per cubic centimeter.

10. The polishing pad according to claim 1, wherein, said pad has a thickness in the range of about 10 to about 130 mils.

11. The polishing pad, according to claim 1, wherein at least one backing layer further comprises up to about 10% by weight of microspheres.

12. The polishing pad, according to claim 11, wherein said microspheres comprise a polymer selected from the group consisting of polyester and polyether urethanes, polycarbonates, polyacrylates, polymethylmethacrylates, polyaramides, thermosetting polymers, epoxies, and combinations thereof.

13. The polishing pad, according to claim 11, wherein the diameter of said microspheres ranges from about 10 $\mu$m to about 100 $\mu$m.

14. The polishing pad, according to claim 1, further comprising an array of voids formed therethrough.

15. The polishing pad according to claim 1, further comprising at least one polishing groove disposed in said polishing suffice.

16. The polishing pad according to claim 1, wherein said at least one polishing groove communicates with at least one void of said array.

17. The polishing pad according to claim 1, further comprising at least one backside groove disposed in a backside of said pad.

18. The polishing pad according to claim 17, wherein said at least one backside groove communicates with at least one void of said array.

19. A method of polishing a surface comprising:

providing a polishing pad comprising:

polymer fibers;

at least one backing layer comprising a portion of said fibers embedded in a cured polymer matrix; and a polishing layer comprising a free length of said fibers disposed as a fibrous mat substantially free of said polymer matrix;

providing a surface to be polished; and contacting said surface with said pad.

20. The method of polishing a surface according to claim 19, wherein said surface to be polished is selected from the group consisting of Al, Al alloys, Cu, Cu alloys, W, W alloys, silicon oxide, polysilicon, silicon nitride, Ta, Ta alloys, Ti, Ti alloys, Au, Au alloys, and combinations thereof.

21. The method of polishing a surface according to claim 20, further comprising providing a polishing compound to said surface to be polished.

22. A method according to claim 21, wherein said polishing is chemical-mechanical polishing (CMP).

* * * * *

UNITED STATES PATENT AND TRADEMARK OFFICE

CERTIFICATE OF CORRECTION

PATENT NO. : 6,964,604 B2
DATED : November 15, 2005
INVENTOR(S) : Shyng-Tsong Chen et al.

It is certified that error appears in the above-identified patent and that said Letters Patent is hereby corrected as shown below:

Column 12,
Line 8, "suffice" should read -- surface --.

Signed and Sealed this

Sixteenth Day of May, 2006

JON W. DUDAS
*Director of the United States Patent and Trademark Office*